US007847773B2

(12) United States Patent
Chiang et al.

(10) Patent No.: US 7,847,773 B2
(45) **Date of Patent: *Dec. 7, 2010**

(54) LIQUID CRYSTAL DISPLAY PIXEL STRUCTURE AND OPERATION METHOD THEREOF

(75) Inventors: Min-Feng Chiang, Hsin-Chu (TW); Hsueh-Ying Huang, Hsin-Chu (TW); Ming-Sheng Lai, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 776 days.

This patent is subject to a terminal disclaimer.

(21) Appl. No.: 11/745,629

(22) Filed: May 8, 2007

(65) Prior Publication Data

US 2008/0048957 A1 Feb. 28, 2008

(30) Foreign Application Priority Data

Aug. 25, 2006 (TW) ..... 95131461 A

(51) Int. Cl.
*G09G 3/36* (2006.01)

(52) U.S. Cl. ..... 345/93; 345/95

(58) Field of Classification Search ..... 345/50, 345/51, 55, 76, 77, 87–111, 694, 695
See application file for complete search history.

(56) References Cited

U.S. PATENT DOCUMENTS 5,448,258 A * 9/1995 Edwards ..... 345/90
5,648,793 A * 7/1997 Chen ..... 345/96
5,825,343 A * 10/1998 Moon ..... 345/94
5,903,249 A * 5/1999 Koyama et al. ..... 345/92
6,850,302 B2 2/2005 Song et al.
7,071,911 B2 * 7/2006 Inukai ..... 345/92
7,355,666 B2 * 4/2008 Song et al. ..... 349/144
7,535,448 B2 * 5/2009 Hiroki ..... 345/89
2003/0095223 A1 5/2003 Song et al.
2004/0155855 A1 8/2004 Chang
2005/0122441 A1 6/2005 Shimoshikiryoh
2006/0023137 A1 2/2006 Kamada et al.
2007/0097057 A1 * 5/2007 Shin ..... 345/98

FOREIGN PATENT DOCUMENTS

TW 200415560 8/2004

(Continued)

OTHER PUBLICATIONS

English language translation of abstract of TW 240103B.

(Continued)

*Primary Examiner*—Chanh Nguyen
*Assistant Examiner*—Pegeman Karimi
(74) *Attorney, Agent, or Firm*—Thomas, Kayden, Horstemeyer & Risley, LLP

(57) ABSTRACT

A pixel unit in the present invention is divided into two sub-pixels. Each sub-pixel includes a thin film transistor, a liquid crystal capacitor and a storage capacitor. The two thin film transistors respectively located in different sub-pixels are connected to different scan lines. One of the two thin film transistors is connected to a data line through another transistor. Therefore, two different pixel voltages are formed in a pixel.

10 Claims, 6 Drawing Sheets

FOREIGN PATENT DOCUMENTS

| | | |
|---|---|---|
| TW | 240103 B | 9/2005 |
| TW | 200604986 | 2/2006 |
| TW | I322401 | 3/2010 |
| TW | I330746 | 9/2010 |

OTHER PUBLICATIONS

S.S. Kim; "66.1: Invited Paper: The World's Largest (82-in.) TFT-LCD;" SID 05 Digest; 2005; pp. 1842-1847.

English language translation of abstract of TW 200415560 (published Aug. 16, 2004).

English language translation of abstract of TW 200604986 (published Feb. 1, 2006).

English language translation of abstract of TW I322401 (published Mar. 21, 2010).

English language translation of abstract of TW I330746 (published Sep. 21, 2010).

* cited by examiner

LIQUID CRYSTAL DISPLAY PIXEL STRUCTURE AND OPERATION METHOD THEREOF

RELATED APPLICATIONS

This application claims priority to Taiwan Application Serial Number 95131461, filed Aug. 25, 2006, which is herein incorporated by reference.

FIELD OF THE INVENTION

The present invention relates to a liquid crystal display, and more particularly, to a liquid crystal display with improved view angles.

BACKGROUND OF THE INVENTION

Liquid crystal displays have been used in various electronic devices. A Multi-Domain Vertically Aligned Mode (MVA mode) liquid crystal display is developed by Fujitsu in 1997 to provide a wider viewing range. In the MVA mode, a 160 degree view angle and a high response speed may be realized. However, when a user looks at this LCD from the oblique direction, the skin color of Asian people (light orange or pink) appears bluish or whitish from an oblique viewing direction. Such a phenomenon is called color shift.

The transmittance-voltage (T-V) characteristic of the MVA mode liquid crystal display is shown in FIG. 1. The vertical axis is the transmittance rate. The horizontal axis is the applied voltage. When the applied voltage is increased, the transmittance rate curve 101 in the normal direction is also increased. The transmittance changes monotonically as the applied voltage increases. In the oblique direction, the transmittance rate curve 102 winds and the various gray scales become the same. However, in the region 100, when the applied voltage is increased, the transmittance rate curve 102 is not increased. That is the reason to cause the color shift.

A method is provided to improve the foregoing problem. According to the method, a pixel unit is divided into two sub pixels. The two sub pixels may generate two different T-V characteristics. By combining the two different T-V characteristics, a monotonic T-V characteristic can be realized. The line 201 in FIG. 2 shows the T-V characteristic of a sub-pixel. The line 202 in FIG. 2 shows the T-V characteristic of another sub-pixel. By combining the two different T-V characteristics of line 201 and line 202, a monotonic T-V characteristic can be realized, as shown by the line 203 in FIG. 2.

Therefore, a pixel unit with two sub pixels and drive method thereof are required.

SUMMARY OF THE INVENTION

One object of the present invention is to provide a liquid crystal display with a wide view angle.

Another object of the present invention is to provide a pixel with two sub pixels.

One aspect of the present invention is directed to a liquid crystal display with a plurality of pixel unit that may be drove by a drive wave to form two different pixel electrode voltages in a pixel unit.

Another aspect of the present invention is directed to a method for driving a liquid crystal display with a plurality of pixel unit, wherein each pixel unit has two sub pixels.

Accordingly, the present invention provides a liquid crystal display, comprising: a plurality of data lines; a plurality of scan lines crossing the data lines, wherein the scan lines are grouped into a first group and a second group, and scan lines of the first group and scan lines of the second group are alternatively arranged; a plurality of pixels defined by two neighboring data lines and two neighboring scan lines crossing the two neighboring data lines; a plurality of first switching devices disposed in first sub-pixels respectively; a plurality of second switching devices electrically coupled to corresponding data lines through the first switching devices respectively; and a plurality of pixel electrodes electrically coupled to the first and second switching devices respectively.

In one embodiment of the present invention, the liquid crystal display further comprises a plurality of third switching disposed in first sub-pixels, wherein the third switching devices are coupled to corresponding data lines through the first switching devices.

The present invention provides a drive method for driving the above liquid crystal display comprising: providing pulse signals to drive the scan lines sequentially, wherein two pulse signals providing to adjacent scan lines partially overlap; and providing two-step signals to the data lines sequentially, the two-step signal includes a first voltage signal and a second voltage signal, wherein the first voltage signal is written to the first sub-pixel through the first transistor when the first and second scan line are driven together, and the second voltage signal is written to the second sub-pixel through adjacent sub-pixel's first transistor and the second transistor when the second scan line and adjacent pixel's first scan line are driven.

According to one embodiment of the present invention, the first signal and the second signal are pulse signals.

According another embodiment of the present invention, the first signal is a pulse signal and the second signal is a clock signal.

Accordingly, a pixel unit in the present invention is divided into two sub-pixels. Each sub-pixel includes a transistor, a liquid crystal capacitor and a storage capacitor. The two transistors respectively located in different sub-pixels are connected to different scan lines. One of the two transistors is connected to the data line through another transistor. Therefore, two different pixel voltages are formed in a pixel.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, where.

DETAILED DESCRIPTION OF THE PREFERRED EMBODIMENT

Figure 1:
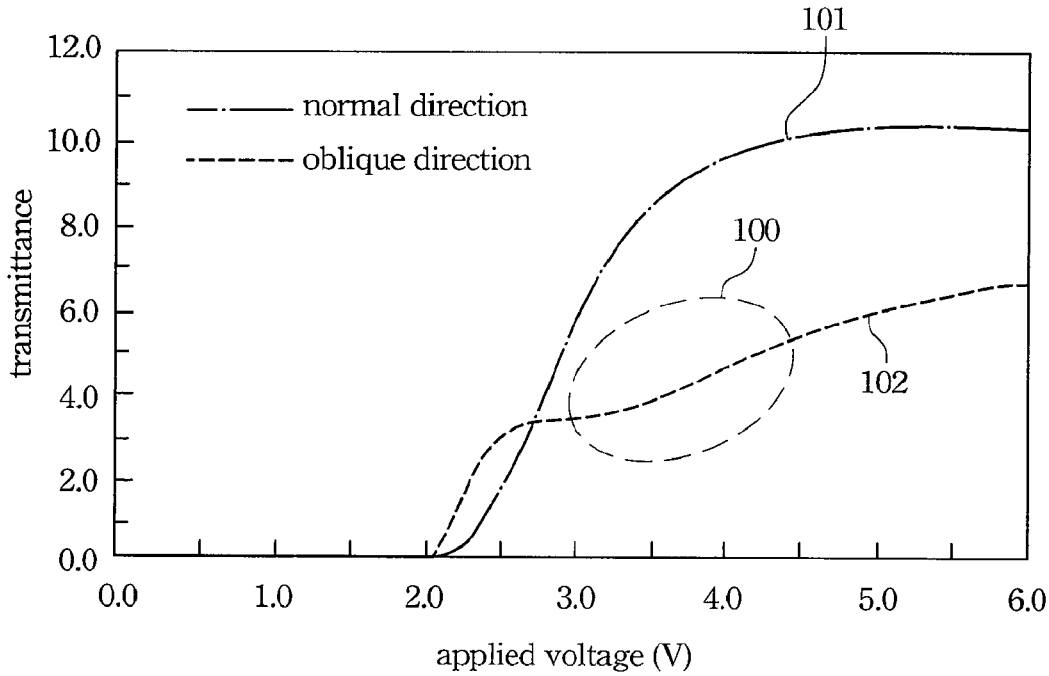
Fig. 1 (PRIOR ART)
FIG. 1 and FIG. 2 illustrate the transmittance-voltage (T-V) characteristic of MVA mode liquid crystal display.
Figure 2:
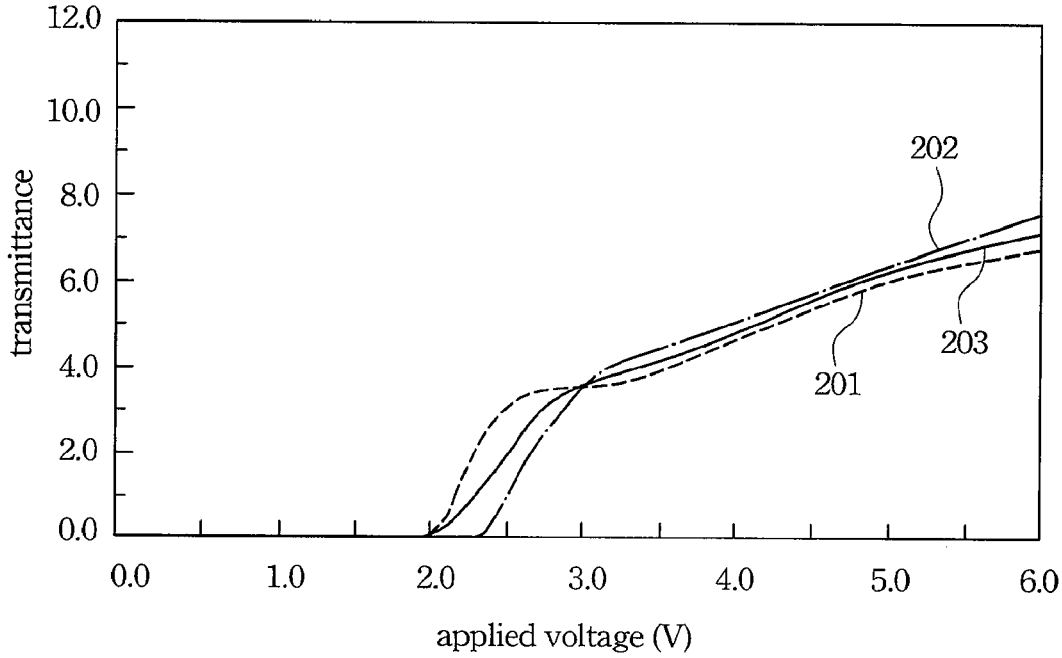
Fig. 2 (PRIOR ART)
Figure 3:
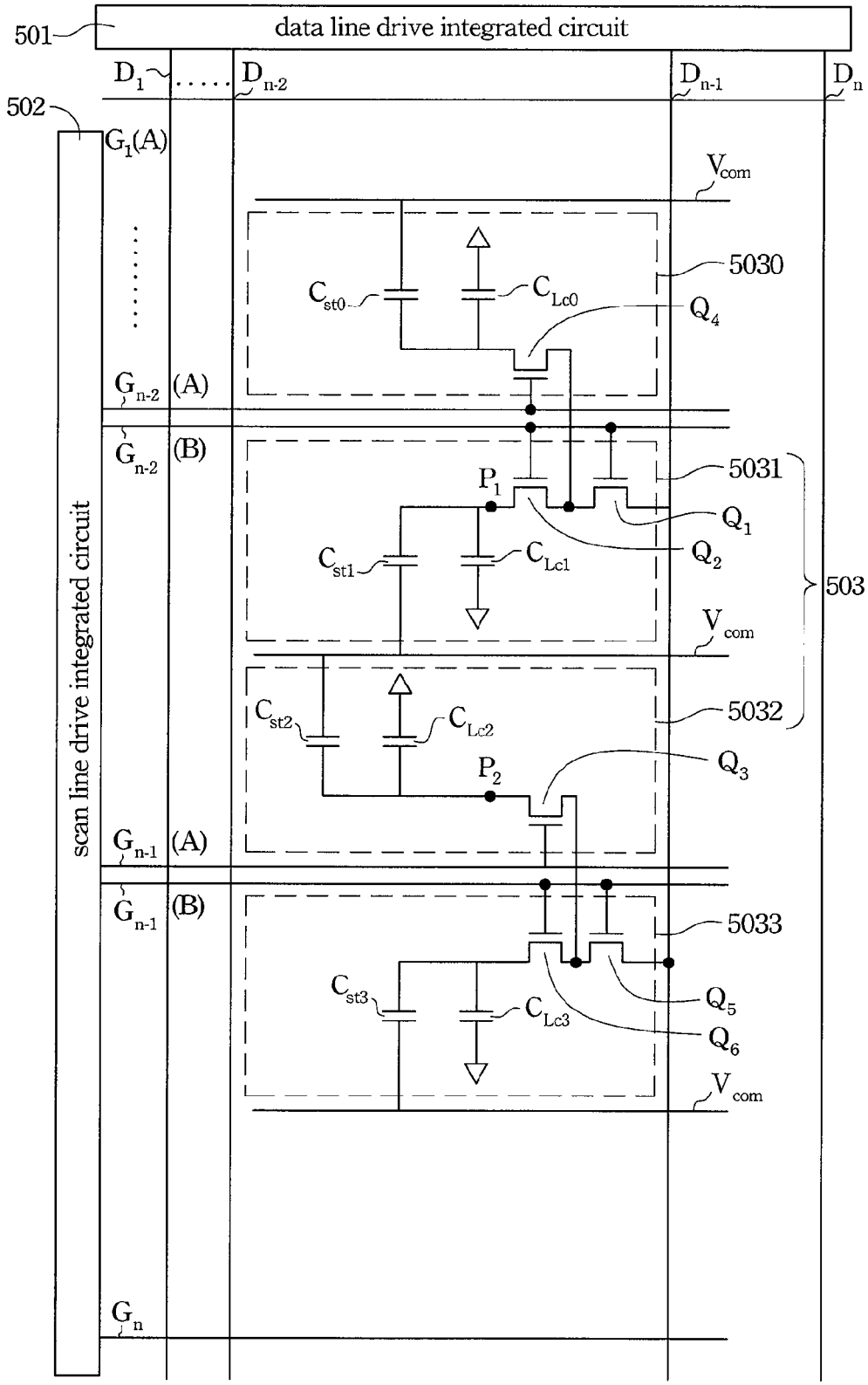
FIG. 3 illustrates a top view of a liquid crystal display according to the first embodiment of the present invention.

FIG. 3 illustrates a top view of a liquid crystal display according to the first embodiment of the present invention. The Liquid crystal display is composed of data lines $D_1$, $D_2$, $D_3$, . . . , $D_n$, the scan lines $G_1(A)$, $G_2(A)$, $G_3(A)$, . . . , $G_n(A)$ of group A and the scan lines $G_2(B)$, $G_3(B)$, . . . , $G_{n-1}(B)$ of group B. These scasn lines are arranged in parallel to each other. Moreover, the scan lines of group A and the scan lines of group B are alternatively formed over a substrate (not shown in FIG. 3). A data line drive integrated circuit 501 is used to control the data lines $D_1$, $D_2$, $D_3$, . . . , $D_n$. A scan line drive integrated circuit 502 is used to control the scan lines $G_1(A)$, $G_2(A)$, $G_3(A)$, $G_n(A)$ of group A and the scan lines $G_2(B)$, $G_3(B)$, . . . , $G_{n-1}$ (B) of group B.

The data lines and the scan lines are perpendicular to each other. Adjacent two data lines and adjacent two scan lines respectively belong to the group A and group B define a pixel unit. Each pixel includes a common electrode Vcom parallel to the scan line. According to the present invention, two transistors are connected to the scan line of group B located between adjacent two pixels to control the data of the data line to transfer to the corresponding pixel.

According to the present invention, a pixel includes two sub-pixels to present different pixel voltage to release the color shift phenomenon. For example, adjacent two data lines $D_{n-2}$ and $D_{n-1}$ and adjacent two scan lines $G_{n-2}(B)$ and $G_{n-1}$ (A) define the pixel 501. A common electrode $V_{com}$ located between and parallel to the scan lines $G_{n-2}(B)$ and $G_{n-1}(A)$. The pixel 503 is divided into two sub-pixels 5031 and 5032. The sub-pixel 5031 is located between the scan line $G_{n-2}(B)$ and the common electrode $V_{com}$. The sub pixel 5032 is located between the scan line $G_{n-1}(A)$ and the common electrode $V_{com}$.

The sub-pixel 5031 includes two transistors $Q_1$ and $Q_2$. According to the embodiment, the gate electrodes of the two transistors $Q_1$ and $Q_2$ are connected to the scan line $G_{n-2}(B)$. The first source/drain electrode of the transistor $Q_1$ is connected to the data line $D_{n-1}$ and the second source/drain electrode of the transistor $Q_1$ is connected to the first source/drain electrode of the transistor $Q_2$. The second source/drain electrode of the transistor $Q_2$ is connected to the pixel electrode $P_1$. The storage capacitor $C_{st1}$ is composed of the pixel electrode $P_1$ and the common electrode $V_{com}$. The liquid crystal capacitor $C_{LC1}$ is composed of the pixel electrode $P_1$ and the conductive electrode in the upper substrate (not shown).

The sub-pixel 5032 also includes a transistor $Q_3$. According to the transistor $Q_3$, the gate electrode is connected to the scan line $G_{n-1}(A)$, the first source/drain electrode is connected to the common connection point of the transistor $Q_5$ and $Q_6$ located in the sub-pixel 5033 and the second source/drain electrode is connected to the pixel electrode $P_2$. The storage capacitor $C_{st2}$ is composed of the pixel electrode $P_2$ and the common electrode $V_{com}$. The liquid crystal capacitor $C_{LC2}$ is composed of the pixel electrode $P_2$ and the conductive electrode in the upper substrate (not shown). In other words, the transistor $Q_3$ is connected to the data line $D_{n-1}$ through the transistor $Q_5$.

The transistors $Q_1$ and $Q_2$ act as switches. When a scan voltage is applied to the gate electrodes of the transistors $Q_1$ and $Q_2$, the data in the data line is transferred to the second source/drain electrode and is written into the corresponding storage capacitor $C_{st1}$ and the liquid crystal capacitor $C_{LC1}$ through the transistors $Q_1$ and $Q_2$. In other words, the transistors $Q_1$ and $Q_2$ together determine wheher or not the sub-pixel 5031 should present the data voltage in the data line.

On the other hand, the transistors $Q_5$ and $Q_3$ act as switches. When a scan voltage is applied to the gate electrodes of the transistors $Q_3$ and $Q_5$, the data in the data line is transferred to the second source/drain electrode of the transistor $Q_3$ through the transistor $Q_5$ and is written into the corresponding storage capacitor $C_{st2}$ and the liquid crystal capacitor $C_{LC2}$. In other words, the transistors $Q_3$ and $Q_5$ together determine wheher or not the sub-pixel 5032 should present the data voltage in the data line.

Figure 4A:
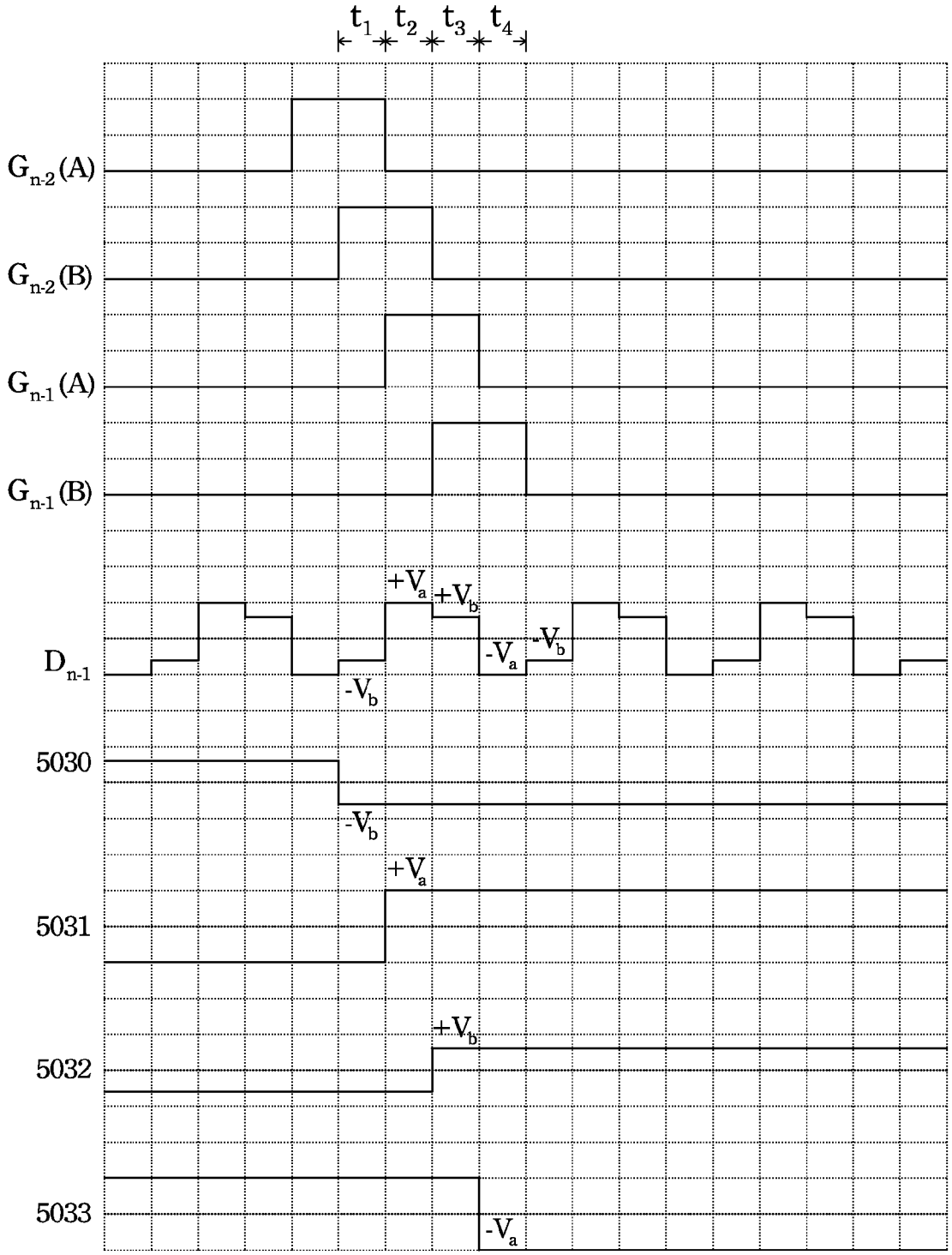
FIG. 4A illustrates a drive waveform and the corresponding electric voltage of four adjacent sub pixels according to the first embodiment of the present invention.

FIG. 4A illustrates a drive waveform and the corresponding electric voltage of four adjacent sub pixels according to an embodiment of the present invention. The drive signal of each scan line is pulse. When scaning, drive signal is sequentially transferred to these scan lines. The time difference between the two drive signals transferred to adjacent scan lines respectively is half period of the pulse. In other words, the two drive signals transferred to adjacent scan lines respectively partially overlap. Therefore, in the time period of the two drive signals overlapping, the transistors connected with the two scan lines are turned on together.

In this embodiment, the drive waveform of the data line is a two steps drive waveform. The positive part of this drive waveform includes two drive voltage Va and Vb. The negative part of this drive waveform also includes two drive voltage −Va and −Vb. The absolute value of the drive voltage Va is larger than the absolute value of the drive voltage Vb.

Referring to FIGS. 3 and 4A, during the time segment $t_1$, the voltage state of both the scan line $G_{n-2}(A)$ and $G_{n-2}(B)$ are in a high level state. The voltage state of both the scan line $G_{n-1}(A)$ and $G_{n-1}(B)$ are in a low level state. Therefore, the transistors $Q_1$, $Q_2$ and $Q_4$ are turned on and the transistors $Q_3$, $Q_5$ and $Q_6$ are turned off. In this case, the voltage −Vb in the data line $D_{n-1}$ may charge the liquid crystal capacitors $C_{LC0}$ and the storage capacitors $C_{st0}$ through the transistors $Q_1$ and $Q_4$. At this time, the sub-pixel 5030 may present the pixel voltage, −Vb. Moreover, the voltage −Vb in the data line $D_{n-1}$ may charge the liquid crystal capacitors $C_{LC1}$ and the storage capacitors $C_{st1}$ through the transistors $Q_1$ and $Q_2$. At this time, the sub-pixel 5031 may also present the pixel voltage, −Vb. The transistors $Q_3$, $Q_5$ and $Q_6$ are turned off. Therefore, the pixel voltage of the sub-pixels 5032 and 5033 is not changed. In this embodiment, the sub-pixel 5032 presents the pixel voltage, −Vb. The sub-pixel 5033 presents the pixel voltage, Va.

During the time segment $t_2$, the voltage state of both the scan line $G_{n-2}(B)$ and $G_{n-1}(A)$ are in a high level state. The voltage state of both the scan line $G_{n-2}(A)$ and $G_{n-1}(B)$ are in a low level state. Therefore, the transistors $Q_1$, $Q_2$ and $Q_3$ are turned on and the transistors $Q_4$, $Q_5$ and $Q_6$ are turned off. In this case, the voltage +Va in the data line $D_{n-1}$ may charge the liquid crystal capacitor $C_{LC1}$ and the storage capacitor $C_{st1}$ through the transistor $Q_1$. At this time, the sub-pixel 5031 may present the pixel voltage, +Va. On the other hand, the transistors $Q_4$, $Q_5$ and $Q_6$ are turned off. Because the transistors $Q_4$ is turned off, the liquid crystal capacitor $C_{LC0}$ and the storage capacitor $C_{st0}$ are not charged by the voltage +Va. At this time, the sub-pixel 5030 still presents the pixel voltage, −Vb. Because the transistors $Q_5$ is turned off and the transistors $Q_3$ is connected to the data line $D_{n-1}$ through the transistors $Q_5$, the liquid crystal capacitors $C_{LC2}$ and the storage capacitors $C_{st2}$ are not charged by the voltage +Va. At this time, the sub-pixel 5032 still present the pixel voltage, −Vb. Because the transistors $Q_5$ and $Q_6$ are turned off, the liquid crystal capacitors $C_{LC3}$ and the storage capacitors $C_{st3}$ are not charged by the voltage +Va. At this time, the sub-pixel 5033 still present the pixel voltage, +Va.

During the time segment $t_3$, the voltage state of both the scan line $G_{n-1}$(A) and $G_{n-1}$(B) are in a high level state. The voltage state of both the scan line $G_{n-2}$(A) and $G_{n-2}$(B) are in a low level state. Therefore, the transistors $Q_3$, $Q_5$ and $Q_6$ are turned on and the transistors $Q_1$, $Q_2$ and $Q_4$ are turned off. In this case, the voltage +Vb in the data line $D_{n-1}$ may charge the liquid crystal capacitor $C_{LC2}$ and the storage capacitor $C_{st2}$ through the transistors $Q_3$ and $Q_5$. At this time, the sub-pixel 5032 may present the pixel voltage, +Vb. On the other hand, the voltage +Vb in the data line $D_{n-1}$ may charge the liquid crystal capacitor $C_{LC3}$ and the storage capacitor $C_{st3}$ through the transistors $Q_5$ and $Q_6$. At this time, the sub-pixel 5033 may present the pixel voltage, +Vb. Because the transistor $Q_4$ is turned off, the liquid crystal capacitor $C_{LC0}$ and the storage capacitor $C_{st0}$ are not charged by the voltage +Vb. At this time, the sub-pixel 5030 still presents the pixel voltage, −Vb. On the other hand, because the transistor $Q_1$ is turned off and the transistors $Q_2$ is connected to the data line $D_{n-1}$ through the transistors $Q_1$, the liquid crystal capacitors $C_{LC1}$ and the storage capacitors $C_{st1}$ are not charged by the voltage +Vb. At this time, the sub-pixel 5031 still present the pixel voltage, +Va.

During the time segment $t_4$, the voltage state of the scan line $G_{n-1}$(B) is in a high level state. The voltage state of both the scan line $G_{n-1}$(A), $G_{n-2}$(A) and $G_{n-2}$(B) are in a low level state. Therefore, the transistors $Q_5$ and $Q_6$ are turned on and the transistors $Q_1$, $Q_2$, $Q_3$ and $Q_4$ are turned off. In this case, the voltage −Va in the data line $D_{n-1}$ may charge the liquid crystal capacitor $C_{LC3}$ and the storage capacitor $C_{st3}$ through the transistors $Q_5$ and $Q_6$. At this time, the sub-pixel 5033 may present the pixel voltage, −Va. Because the transistors $Q_3$ and $Q_4$ are turned off, the liquid crystal capacitor $C_{LC0}$ and the storage capacitor $C_{st0}$ are not charged by the voltage −Vb. At this time, the sub-pixel 3030 still presents a pixel voltage, −Vb. Because the transistors $Q_1$ and $Q_4$ are turned off, the liquid crystal capacitors $C_{LC0}$ and the storage capacitors $C_{st0}$ are not charged by the voltage −Va. At this time, the sub-pixel 5030 still presents the pixel voltage, −Vb. Because the transistors $Q_1$ and $Q_2$ are turned off, the liquid crystal capacitors $C_{LC1}$ and the storage capacitors $C_{st1}$ are not charged by the voltage −Va. At this time, the sub-pixel 5031 still presents the pixel voltage, +Va. Because the transistor $Q_3$ is turned off, the liquid crystal capacitors $C_{LC2}$ and the storage capacitors $C_{st2}$ are not charged by the voltage −Va. At this time, the sub-pixel 5032 still presents the pixel voltage, +Vb.

Accordingly, from the time segment $t_1$ to $t_4$, at least two pixel voltages, Vb and +Va, are presented in the pixel 503 together. Different pixel voltage may present different optical characteristics. Therefore, the color shift phenomenon may be eased by combining the two pixel voltages in a pixel.

Figure 4B:
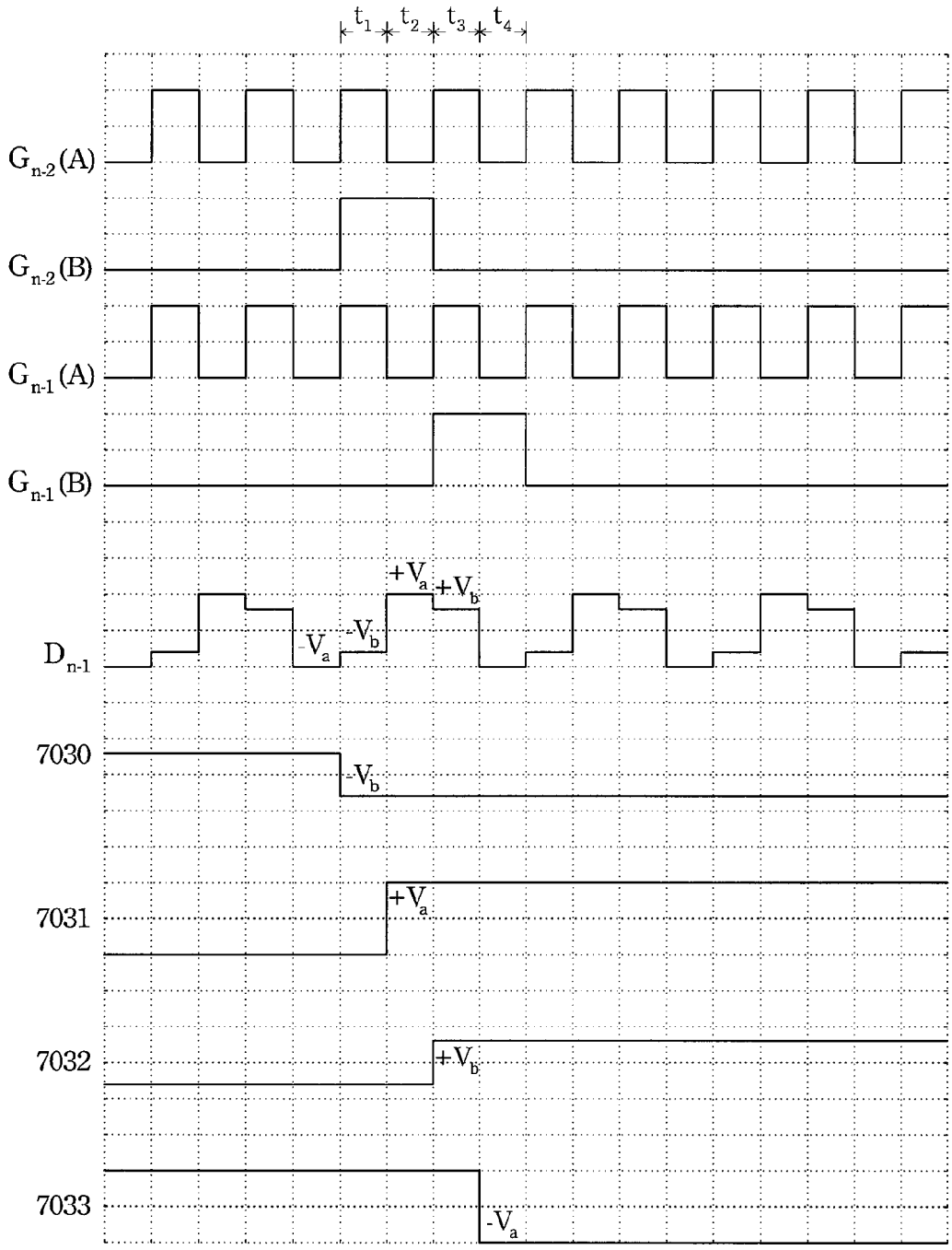
FIG. 4B illustrates another drive waveform and the corresponding electric voltage of four adjacent sub pixels according to the first embodiment of the present invention.

FIG. 4B illustrates a drive waveform and the corresponding electric voltage of four adjacent sub pixels according to another embodiment of the present invention. The drive signal transferred in the scan line of the group A is a clock signal. The drive signal transferred in the scan line of the group B is pulse signal. When scaning, pulse signal is sequentially transferred to these scan lines of the group B. The pulse width is equal to the period the closk signal. In other words, the two drive signals, the clock signal and the pulse signal, transferred to adjacent scan lines respectively partially overlap. Therefore, in the time period of the two drive signals overlapping, the transistors connected with the two scan lines are turned on together.

In this embodiment, the drive waveform of the data line is a two steps drive waveform. The positive part of this drive waveform includes two drive voltage Va and Vb. The negative part of this drive waveform also includes two drive voltage −Va and −Vb. The absolute value of the drive voltage Va is larger than the absolute value of the drive voltage Vb.

Referring to FIGS. 3 and 4B, during the time segment $t_1$, the voltage state of the scan line $G_{n-1}$(A), $G_{n-2}$(A) and $G_{n-2}$(B) are in a high level state. The voltage state of the scan line $G_{n-1}$(B) is in a low level state. Therefore, the transistors $Q_1$, $Q_2$, $Q_3$ and $Q_4$ are turned on and the transistors $Q_5$ and $Q_6$ are turned off. In this case, the voltage −Vb in the data line $D_{n-1}$ may charge the liquid crystal capacitors $C_{LC0}$ and the storage capacitors $C_{st0}$ through the transistors $Q_3$ and $Q_4$. At this time, the sub-pixel 5030 may present the pixel voltage, −Vb. Moreover, the voltage −Vb in the data line $D_{n-1}$ may charge the liquid crystal capacitors $C_{LC1}$ and the storage capacitors $C_{st1}$ through the transistors $Q_1$ and $Q_2$. At this time, the sub-pixel 5031 may also present the pixel voltage, −Vb. The transistors $Q_5$ and $Q_6$ are turned off. The transistor $Q_3$ is connected to the data line $D_{n-1}$ through the transistors $Q_5$. Therefore, the liquid crystal capacitor $C_{LC2}$ and the storage capacitor $C_{st2}$ are not charged by the voltage −Vb. On the other hand, because the transistor $Q_6$ is turned off, the liquid crystal capacitors $C_{LC3}$ and the storage capacitors $C_{st3}$ are not charged by the voltage −Vb. Therefore, the sub-pixel 5032 and the sub-pixel 5033 still present the pixel voltage of the previous state. In this embodiment, the sub-pixel 5032 presents the pixel voltage, −Vb. The sub-pixel 5033 presents the pixel voltage, Va.

During the time segment $t_2$, the voltage state of both the scan line $G_{n-2}$(B) is in a high level state. The voltage state of the scan lines $G_{n-1}$(A), $G_{n-2}$(A) and $G_{n-1}$(B) are in a low level state. Therefore, the transistors $Q_1$ and $Q_2$ are turned on and the transistors $Q_3$, $Q_4$, $Q_5$ and $Q_6$ are turned off. In this case, the voltage +Va in the data line $D_{n-1}$ may charge the liquid crystal capacitor $C_{LC1}$ and the storage capacitor $C_{st1}$ through the transistors $Q_1$ and $Q_2$. At this time, the sub-pixel 5031 may present the pixel voltage, +Va. On the other hand, because the transistor $Q_4$ is turned off, the liquid crystal capacitor $C_{LC0}$ and the storage capacitor $C_{st0}$ are not charged by the voltage +Va. At this time, the sub-pixel 5030 still presents the previous pixel voltage state, −Vb. Because the transistor $Q_3$ is turned off, the liquid crystal capacitors $C_{LC2}$ and the storage capacitors $C_{st2}$ are not charged by the voltage +Va. At this time, the sub-pixel 5032 still present the previous pixel voltage state, −Vb. Because the transistor $Q_6$ is turned off, the liquid crystal capacitors $C_{LC3}$ and the storage capacitors $C_{st3}$ are not charged by the voltage +Va. At this time, the sub-pixel 5033 still present the previous pixel voltage state, +Va.

During the time segment $t_3$, the voltage state of the scan line $G_{n-1}$(A), $G_{n-2}$(A) and $G_{n-1}$(B) are in a high level state. The voltage state of the scan line $G_{n-2}$(B) is in a low level state. Therefore, the transistors $Q_3$, $Q_4$, $Q_5$ and $Q_6$ are turned on and the transistors $Q_1$, $Q_2$ and are turned off. In this case, the voltage +Vb in the data line $D_{n-1}$ may charge the liquid crystal capacitor $C_{LC2}$ and the storage capacitor $C_{st2}$ through the transistors $Q_3$ and $Q_5$. At this time, the sub-pixel 5032 may present the pixel voltage, +Vb. On the other hand, the voltage +Vb in the data line $D_{n-1}$ may charge the liquid crystal capacitor $C_{LC3}$ and the storage capacitor $C_{st3}$ through the transistors $Q_5$ and $Q_6$. At this time, the sub-pixel 5033 may present the pixel voltage, +Vb. Because the transistor $Q_1$ is turned off and the transistor $Q_4$ is coupled to the data line $D_{n-1}$ through the transistor $Q_1$, the liquid crystal capacitors $C_{LC0}$ and the storage capacitors $C_{st0}$ are not charged by the voltage +Vb. At this time, the sub-pixel 5030 still present the pixel voltage, −Vb. On the other hand, because the transistors $Q_1$ and $Q_2$ are turned off, the liquid crystal capacitor $C_{LC1}$ and the storage capacitor $C_{st1}$ are not charged by the voltage +Vb. At this time, the sub-pixel 5031 still presents the pixel voltage, Va.

During the time segment $t_4$, the voltage state of the scan line $G_{n-1}$(B) is in a high level state. The voltage state of both the scan line $G_{n-1}$(A), $G_{n-2}$(A) and $G_{n-2}$(B) are in a low level state. Therefore, the transistors $Q_5$ and $Q_6$ are turned on and the transistors $Q_1$, $Q_2$, $Q_3$ and $Q_4$ are turned off. In this case, the voltage −Vb in the data line $D_{n-1}$ may charge the liquid crystal capacitor $C_{LC3}$ and the storage capacitor $C_{st3}$ through the transistors $Q_5$ and $Q_6$. At this time, the sub-pixel 5033 may present the pixel voltage, −Vb. Because the transistor $Q_4$ is turned off, the liquid crystal capacitor $C_{LC0}$ and the storage capacitor $C_{st0}$ are not charged by the voltage −Vb. At this time, the sub-pixel 5030 still presents the previous pixel voltage state, −Vb. Because the transistors $Q_1$ and $Q_2$ are turned off, the liquid crystal capacitors $C_{LC1}$ and the storage capacitors $C_{st1}$ are not charged by the voltage −Vb. At this time, the sub-pixel 5031 still presents the previous pixel voltage state, +Va. Because the transistor $Q_3$ is turned off, the liquid crystal capacitors $C_{LC2}$ and the storage capacitors $C_{st2}$ are not charged by the voltage −Vb. At this time, the sub-pixel 5032 still presents the previous pixel voltage state, +Vb.

Accordingly, from the time segment $t_1$ to $t_4$, at least two pixel voltages, Vb and +Va, are presented in the pixel 503 together. Different pixel voltage may present different optical characteristics. Therefore, the color shift phenomenon may be eased by combining the two pixel voltages in a pixel.

Figure 5:
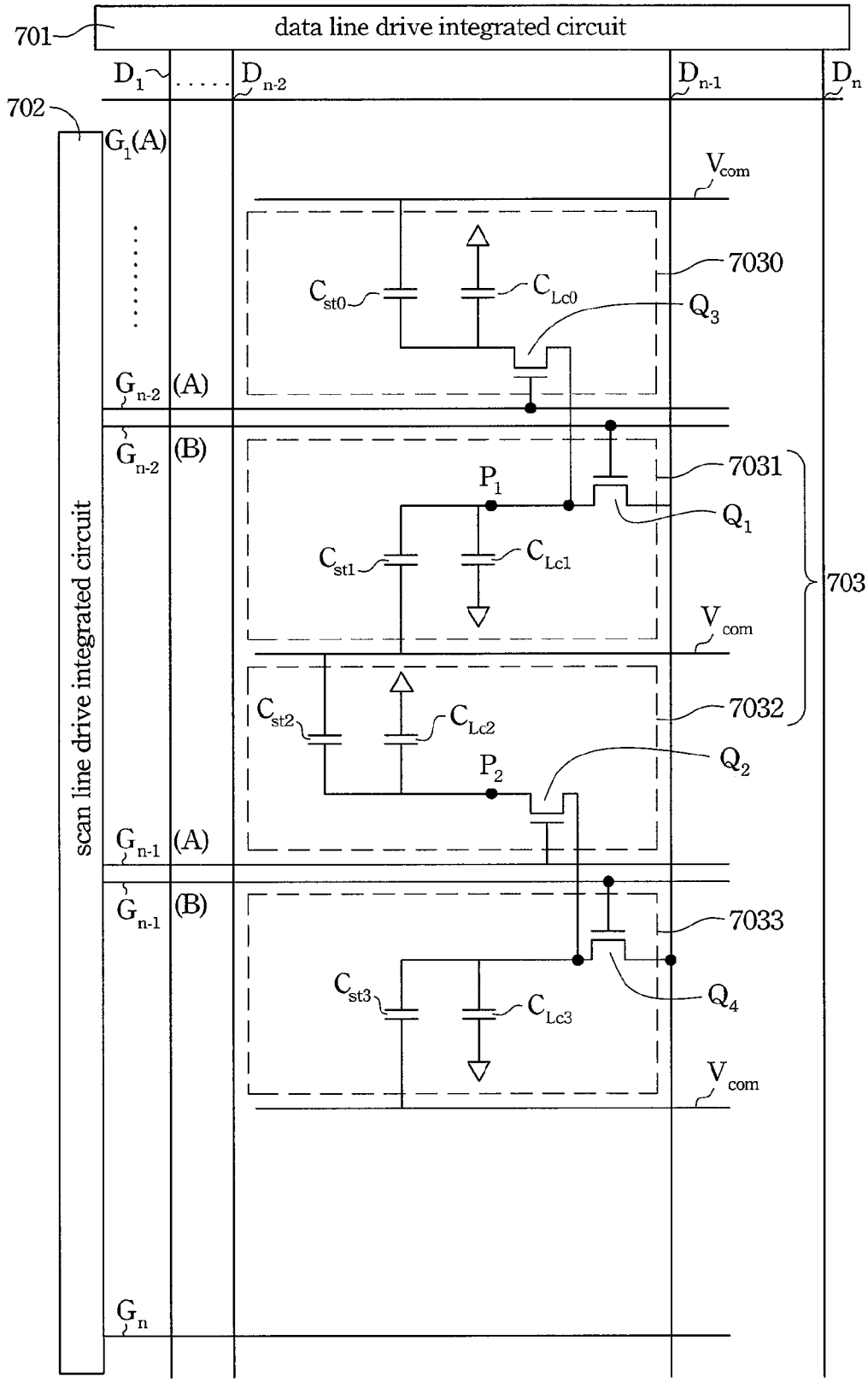
FIG. 5 illustrates a top view of a liquid crystal display according to the second embodiment of the present invention.

FIG. 5 illustrates a top view of a liquid crystal display according to the second embodiment of the present invention. The Liquid crystal display is composed of data lines $D_1$, $D_2$, $D_3$, . . . , $D_n$, the scan lines $G_1$(A), $G_2$(A), $G_3$(A), . . . , $G_n$(A) of group A and the scan lines $G_2$(B), $G_3$(B), . . . , $G_{n-1}$(B) of group B. These scasn lines are arranged in parallel to each other. Moreover, the scan lines of group A and the scan lines of group B are alternatively formed over a substrate (not shown). A data line drive integrated circuit 701 is used to control the data lines $D_1$, $D_2$, $D_3$, . . . , $D_n$. A scan line drive integrated circuit 702 is used to control the scan lines $G_1$(A), $G_2$(A), $G_3$(A), . . . , $G_n$(A) of group A and the scan lines $G_2$(B), $G_3$(B), . . . , $G_{n-1}$(B) of group B. The data lines and the scan lines are perpendicular to each other. Adjacent two data lines and adjacent two scan lines respectively belong to the group A and group B define a pixel unit. Each pixel includes a common electrode $V_{com}$ parallel to the scan line.

According to the present invention, a pixel includes two sub-pixels to present different pixel voltage to release the color shift phenomenon. For example, adjacent two data lines $D_{n-2}$ and $D_{n-1}$ and adjacent two scan lines $G_{n-2}$(B) and $G_{n-1}$(A) define the pixel 701. A common electrode $V_{com}$ located between and parallel to the scan lines $G_{n-2}$(B) and $G_{n-1}$(A). The pixel 703 is divided into two sub-pixels 7031 and 7032. The sub-pixel 7031 is located between the scan line $G_{n-2}$(B) and the common electrode $V_{com}$. The sub pixel 7032 is located between the scan line $G_{n-1}$(A) and the common electrode $V_{com}$.

The sub-pixel 7031 includes one transistor $Q_1$. According to the embodiment, the gate electrodes of the transistor $Q_1$ is connected to the scan line $G_{n-2}$(B). The first source/drain electrode of the transistor $Q_1$ is connected to the data line $D_{n-1}$ and the second source/drain electrode of the transistor $Q_1$ is connected to the pixel electrode $P_1$. The storage capacitor $C_{st1}$ is composed of the pixel electrode $P_1$ and the common electrode $V_{com}$. The liquid crystal capacitor $C_{LC1}$ is composed of the pixel electrode $P_1$ and the conductive electrode in the upper substrate (not shown).

The sub-pixel 7032 also includes a transistor $Q_2$. According to the transistor $Q_2$, the gate electrode is connected to the scan line $G_{n-1}$(A), the first source/drain electrode is connected to the transistor $Q_4$ located in the sub-pixel 7033 and the second source/drain electrode is connected to the pixel electrode $P_2$. The storage capacitor $C_{st2}$ is composed of the pixel electrode $P_2$ and the common electrode $V_{com}$. The liquid crystal capacitor $C_{LC2}$ is composed of the pixel electrode $P_2$ and the conductive electrode in the upper substrate (not shown). In other words, the transistor $Q_2$ is connected to the data line $D_{n-1}$ through the transistor $Q_4$.

The transistor $Q_1$ acts as a switch. When a scan voltage is applied to the gate electrodes of the transistor $Q_1$, the data in the data line is transferred to the second source/drain electrode and is written into the corresponding storage capacitor $C_{st1}$ and the liquid crystal capacitor $C_{LC1}$ through the transistor $Q_1$. In other words, the transistor $Q_1$ determine wheher or not the sub-pixel 7031 should present the data voltage in the data line.

On the other hand, the transistors $Q_2$ and $Q_4$ act as switches. When a scan voltage is applied to the gate electrodes of the transistors $Q_2$ and $Q_4$, the data in the data line is transferred to the second source/drain electrode of the transistor $Q_2$ through the transistor $Q_4$ and is written into the corresponding storage capacitor $C_{st2}$ and the liquid crystal capacitor $C_{LC2}$. In other words, the transistors $Q_2$ and $Q_4$ together determine wheher or not the sub-pixel 7032 should present the data voltage in the data line.

Figure 6:
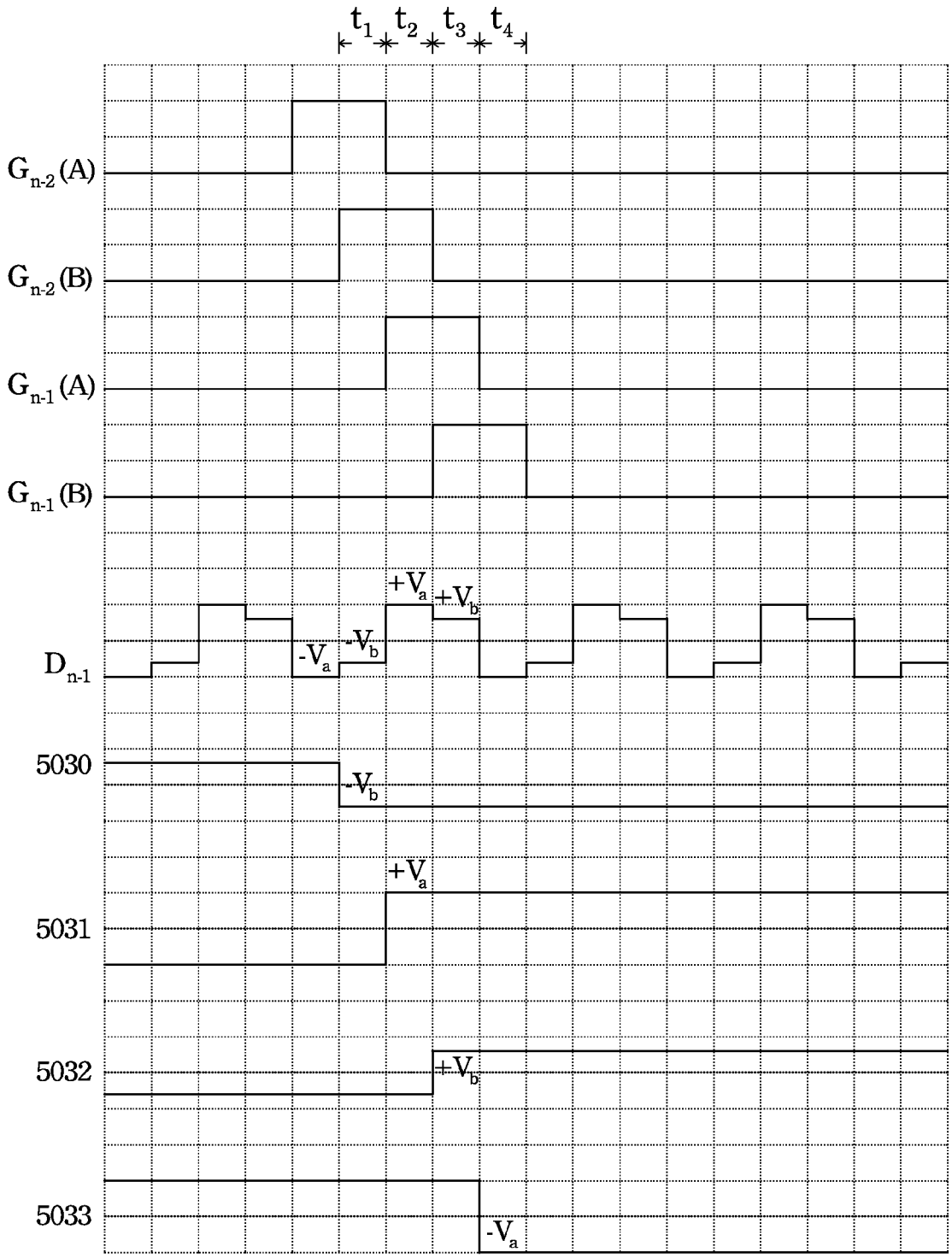
FIG. 6 illustrates a drive waveform and the corresponding electric voltage of four adjacent sub pixels according to the second embodiment of the present invention.

FIG. 6 illustrates a drive waveform and the corresponding electric voltage of four adjacent sub pixels according to an embodiment of the present invention. The drive signal of each scan line is pulse. When scaning, drive signal is sequentially transferred to these scan lines. The time difference between the two drive signals transferred to adjacent scan lines respectively is half period of the pulse. In other words, the two drive signals transferred to adjacent scan lines respectively partially overlap. Therefore, in the time period of the two drive signals overlapping, the transistors connected with the two scan lines are turned on together.

In this embodiment, the drive waveform of the data line is a two steps drive waveform. The positive part of this drive waveform includes two drive voltage Va and Vb. The negative part of this drive waveform also includes two drive voltage −Va and −Vb. The absolute value of the drive voltage Va is larger than the absolute value of the drive voltage Vb.

Referring to FIGS. 5 and 6, during the time segment $t_1$, the voltage state of both the scan line $G_{n-2}$(A) and $G_{n-2}$(B) are in a high level state. The voltage state of both the scan line $G_{n-1}$(A) and $G_{n-1}$(B) are in a low level state. Therefore, the transistors $Q_1$ and $Q_3$ are turned on and the transistors $Q_2$ and $Q_4$ are turned off. In this case, the voltage −Vb in the data line $D_{n-1}$ may charge the liquid crystal capacitors $C_{LC0}$ and the storage capacitors $C_{st0}$ through the transistors $Q_1$ and $Q_3$. At this time, the sub-pixel 7030 may present the pixel voltage, −Vb. Moreover, the voltage −Vb in the data line $D_{n-1}$ may charge the liquid crystal capacitors $C_{LC1}$ and the storage capacitors $C_{st1}$ through the transistor $Q_1$. At this time, the sub-pixel 7031 may also present the pixel voltage, −Vb. The transistors $Q_2$ and $Q_4$ are turned off. Therefore, the pixel voltage of the sub-pixels 7032 and 7033 are not changed. In this embodiment, the sub-pixel 7032 presents the pixel voltage, −Vb. The sub-pixel 7033 presents the pixel voltage, Va.

During the time segment $t_2$, the voltage state of both the scan line $G_{n-2}$(B) and $G_{n-1}$(A) are in a high level state. The voltage state of both the scan line $G_{n-2}$(A) and $G_{n-1}$(B) are in a low level state. Therefore, the transistors $Q_1$ and $Q_2$ are turned on and the transistors $Q_4$, and $Q_3$ are turned off. In this case, the voltage +Va in the data line $D_{n-1}$ may charge the liquid crystal capacitor $C_{LC1}$ and the storage capacitor $C_{st1}$ through the transistor $Q_1$. At this time, the sub-pixel 7031 may present the pixel voltage, +Va. On the other hand, the transistors $Q_4$ and $Q_3$ are turned off. Because the transistors $Q_3$ is turned off, the liquid crystal capacitor $C_{LC0}$ and the storage capacitor $C_{St0}$ are not charged by the voltage +Va. At this time, the sub-pixel 7030 still presents the pixel voltage, −Vb. Because the transistors $Q_4$ is turned off and the transistors $Q_2$ is connected to the data line $D_{n-1}$ through the transistors $Q_4$, the liquid crystal capacitors $C_{LC2}$ and the storage capacitors $C_{St2}$ are not charged by the voltage +Va. At this time, the sub-pixel 7032 still present the pixel voltage, −Vb. Because the transistor $Q_4$ is turned off, the liquid crystal capacitors $C_{LC3}$ and the storage capacitors $C_{St3}$ are not charged by the voltage +Va. At this time, the sub-pixel 7033 still present the pixel voltage, +Va.

During the time segment $t_3$, the voltage state of both the scan line $G_{n-1}(A)$ and $G_{n-1}(B)$ are in a high level state. The voltage state of both the scan line $G_{n-2}(A)$ and $G_{n-2}(B)$ are in a low level state. Therefore, the transistors $Q_2$, and $Q_4$ are turned on and the transistors $Q_1$ and $Q_3$ are turned off. In this case, the voltage +Vb in the data line $D_{n-1}$ may charge the liquid crystal capacitor $C_{LC2}$ and the storage capacitor $C_{st2}$ through the transistors $Q_2$ and $Q_4$. At this time, the sub-pixel 7032 may present the pixel voltage, +Vb. On the other hand, the voltage +Vb in the data line $D_{n-1}$ may charge the liquid crystal capacitor $C_{LC3}$ and the storage capacitor $C_{st3}$ through the transistor $Q_4$. At this time, the sub-pixel 7033 may present the pixel voltage, +Vb. Because the transistor $Q_3$ is turned off, the liquid crystal capacitor $C_{LC0}$ and the storage capacitor $C_{St0}$ are not charged by the voltage +Vb. At this time, the sub-pixel 7030 still presents the pixel voltage, −Vb. On the other hand, because the transistor $Q_1$ is turned off and the transistors $Q_2$ is connected to the data line $D_{n-1}$ through the transistors $Q_1$, the liquid crystal capacitors $C_{LC1}$ and the storage capacitors $C_{St1}$ are not charged by the voltage +Vb. At this time, the sub-pixel 7031 still present the pixel voltage, +Va.

During the time segment $t_4$, the voltage state of the scan line $G_{n-1}(B)$ is in a high level state. The voltage state of both the scan line $G_{n-1}(A)$, $G_{n-2}(A)$ and $G_{n-2}(B)$ are in a low level state. Therefore, the transistor $Q_4$ is turned on and the transistors $Q_1$, $Q_2$ and $Q_3$ are turned off. In this case, the voltage −Va in the data line $D_{n-1}$ may charge the liquid crystal capacitor $C_{LC3}$ and the storage capacitor $C_{st3}$ through the transistor $Q_{46}$. At this time, the sub-pixel 7033 may present the pixel voltage, −Va. Because the transistor $Q_3$ is turned off, the liquid crystal capacitor $C_{LC0}$ and the storage capacitor $C_{St0}$ are not charged by the voltage −Vb. At this time, the sub-pixel 7030 still presents a pixel voltage, −Vb. Because the transistor $Q_1$ is turned off, the liquid crystal capacitors $C_{LC1}$ and the storage capacitors $C_{St1}$ are not charged by the voltage −Va. At this time, the sub-pixel 7031 still presents the pixel voltage, Va. Because the transistor $Q_2$ is turned off, the liquid crystal capacitors $C_{LC2}$ and the storage capacitors $C_{St2}$ are not charged by the voltage −Va. At this time, the sub-pixel 7032 still presents the pixel voltage, +Vb.

Accordingly, from the time segment $t_1$ to $t_4$, at least two pixel voltages, Vb and +Va, are presented in the pixel 703 together. Different pixel voltage may present different optical characteristics. Therefore, the color shift phenomenon may be eased by combining the two pixel voltages in a pixel.

Accordingly, a pixel unit in the present invention is divided into two sub-pixels. Each sub-pixel includes a thin film transistor, a liquid crystal capacitor and a storage capacitor. The two transistors in a pixel are connected to different scan lines. One of the two transistors is connected to the data line through another transistor. Therefore, two different pixel voltages are formed in a pixel. The color shift phenomenon may be eased by combining the two pixel voltages in a pixel.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures.

What is claimed is:

1. A drive method for driving a liquid crystal display, wherein said liquid crystal display comprises: a plurality of data lines; a plurality of scan lines crossing said data lines; a plurality of pixels defined by two neighboring data lines and two neighboring scan lines crossing the two neighboring data lines, wherein each pixel comprises: a first pixel electrode; a second pixel electrode; a common electrode, wherein said common electrode and said first pixel electrode define a first sub-pixel and said common electrode and said second pixel electrode define a second sub-pixel; a first transistor located in said first sub-pixel, a gate electrode of said first transistor is connected to said first scan line, a first source/drain electrode of said first transistor is connected to said first data line; a second transistor located in said first sub-pixel, a gate electrode of said second transistor is connected to said first scan line, a first source/drain electrode of said second transistor is connected to a second source/drain electrode of said first transistor and a second source/drain electrode of said second transistor is connected to said first pixel electrode, wherein said second transistor is coupled to said first data line through said first transistor, wherein data in said first data line is transferred to said first pixel electrode through said first transistor and said second transistor; and a third transistor located in said second sub-pixel, a gate electrode of said third transistor is connected to said second scan line, a first source/drain electrode of said third transistor is connected to a common connection point of said first transistor and said second transistor and a second source/drain electrode of said third transistor is connected to a second pixel electrode, wherein said third transistor is coupled to said first data line through said first transistor, wherein data in said first data line is transferred to said second pixel electrode through said first transistor and said third transistor, said method comprises:

providing pulse signals to drive said scan lines sequentially, wherein two pulse signals providing to adjacent scan lines partially overlap; and providing two-step signals to said data lines sequentially, said two-step signal includes a first voltage signal and a second voltage signal, wherein said first voltage signal is written to said first sub-pixel through said first transistor when said first and second scan line are driven together, and said second voltage signal is written to said second sub-pixel through adjacent sub-pixel's first transistor and said third transistor when said second scan line and adjacent pixel's first scan line are driven.

2. The drive method of claim 1, wherein an overlap width of two pulse signals is equal to half width of the pulse signals.

3. The drive method of claim 1, wherein the value of said first voltage signal is larger than the value of said second voltage signal.

4. A drive method for driving a liquid crystal display, wherein said liquid crystal display comprises: a plurality of data lines; a plurality of scan lines crossing said data lines; a plurality of pixels defined by two neighboring data lines and two neighboring scan lines crossing the two neighboring data lines, wherein each pixel comprises: a first pixel electrode; a second pixel electrode; a common electrode, wherein said common electrode and said first pixel electrode define a first sub-pixel and said common electrode and said second pixel electrode define a second sub-pixel; a first transistor located in said first sub-pixel, a gate electrode of said first transistor is connected to said first scan line, a first source/drain electrode of said first transistor is connected to said first data line; a second transistor located in said first sub-pixel, a gate electrode of said second transistor is connected to said first scan line, a first source/drain electrode of said second transistor is connected to a second source/drain electrode of said first transistor and a second source/drain electrode of said second transistor is connected to said first pixel electrode, wherein said second transistor is coupled to said first data line through said first transistor, wherein data in said first data line is transferred to said first pixel electrode through said first transistor and said second transistor; and a third transistor located in said second sub-pixel, a gate electrode of said third transistor is connected to said second scan line, a first source/drain electrode of said third transistor is connected to a common connection point of said first transistor and said second transistor and a second source/drain electrode of said third transistor is connected to a second pixel electrode, wherein said third transistor is coupled to said first data line through said first transistor, wherein data in said first data line is transferred to said second pixel electrode through said first transistor and said third transistor, said method comprises:

providing a first signal to said first scan line;

providing a second signal to said second scan line, wherein said first signal and said second signal partially overlap; and providing two-step signals to said data lines sequentially, said two-step signal includes a first voltage signal and a second voltage signal, wherein said first voltage signal is written to said first sub-pixel through said first transistor and said second transistor when said first scan line is driven by said first signal, and said second voltage signal is written to said second sub-pixel through adjacent pixel's first transistor and said third transistor when said first scan line is not driven and said second scan line is driven by said second signal and adjacent pixel's first scan line is driven by said first signal.

5. The drive method of claim 4, wherein an overlap width of two pulse signals is equal to half of a width of the pulse signals.

6. The drive method of claim 4, wherein the first signal and the second signal are pulse signals.

7. The drive method of claim 6, wherein said second scan line is driven by pulse signal when said first scan line is driven by pulse signal.

8. The drive method of claim 4, wherein the first signal is a pulse signal and the second signal is a clock signal.

9. The drive method of claim 8, wherein said second scan line is not driven by clock signal when said first scan line is driven by pulse signal.

10. The drive method of claim 4, wherein the value of said first voltage signal is larger than the value of said second voltage signal.

* * * * *